United States Patent [19]

Diermayer et al.

[11] 4,337,892

[45] Jul. 6, 1982

[54] DRAFT CONTROL ARRANGEMENT FOR VENT OF COMBUSTION APPARATUS

[76] Inventors: Werner Diermayer, 1275 Panorama Dr., Lafayette, Calif. 94549; Luitpold Kutzner, Marschnerstrasse 78, D-8000 Munich, Fed. Rep. of Germany

[21] Appl. No.: 198,046

[22] Filed: Oct. 17, 1980

[51] Int. Cl.[3] ..... G05D 23/02

[52] U.S. Cl. ..... 236/93 R; 236/1 G; 126/285 R; 126/292

[58] Field of Search ..... 126/285 R, 285 A, 292, 126/290, 293, 307 R; 236/93 R, 101 E, 1 G, 73 R; 431/20

[56] References Cited

U.S. PATENT DOCUMENTS

| | | | |
|---|---|---|---|
| 2,109,628 | 3/1938 | Alban et al. | 236/93 R |
| 4,141,495 | 2/1979 | Diermeyer | 236/93 R |
| 4,227,646 | 10/1980 | Hart et al. | 236/101 D |
| 4,249,694 | 2/1981 | Diermeyer et al. | 236/93 R |

*Primary Examiner*—James C. Yeung

*Attorney, Agent, or Firm*—Flehr, Hohbach, Test, Albritton & Herbert

[57] ABSTRACT

A draft control arrangement for a heating apparatus. The draft control arrangement includes a vent damper comprised of one element formed of a shape memory material and another element form of a thermostat material with the elements arranged for coacting to provide a rapid rate of flow passage opening during an initial phase of temperature rise followed by a rate of flow area opening substantially proportional to further temperature rise.

8 Claims, 7 Drawing Figures

DRAFT CONTROL ARRANGEMENT FOR VENT OF COMBUSTION APPARATUS

BACKGROUND

Vented, gas-fired appliances relying on natural draft for the removal of products of combustion are equipped with a draft hood which isolates the combustion chamber from excessive updraft or backdraft in the vent. The conduit between the draft hood relief opening and the outside is permanently open and therefore causes heat loss, especially during cold and windy weather.

To reduce the heat loss automatic vent dampers are installed between the draft hood and vent connector. The heat savings are optimized by restricting the air flow in the vent to a safe minimum.

During standby the safe minimum is a sufficient air flow to remove the vent gases of the pilot flame, if so equipped, and to provide some air change in the vent to prevent excess condensation.

During the operating phase of the appliance the safe minimum is a sufficient air flow to remove the products of combustion while retaining heated room air, regardless of the varying draft in the vent.

Thermally actuated vent dampers have been designed to perform these vent restrictions.

DESCRIPTION AND DRAWINGS

Thermally actuated vent dampers open in response to heat from the main burner, i.e. products of combustion rise to the damper while it is still closed and escape temporarily through the draft hood relief opening. Therefore, one main object of the invention is to provide in the design of thermally actuated vent dampers a partial passage opening as quickly as possible after burner ignition to allow the flow of products of combustion through the vent.

During the operating phase of the applicance the amount of products of combustion may vary, e.g. if the applicance is equipped with a multistage or modulating gas valve. Also, the draft in the vent may be high or low, depending on the height of the vent and on weather conditions. Therefore, another object is to provide a damper of the type described with sufficient modulating capability to minimize the loss of room air regardless of the above-mentioned variations of draft and quantity of products of combustion.

The invention achieves the two main objects by arranging in combination two actuating elements, one element comprising a temperature-responsive thermostat material, such as bimetal, and the other comprising a shape memory material, such as nitinol.

PRIOR ART

Figure 1:
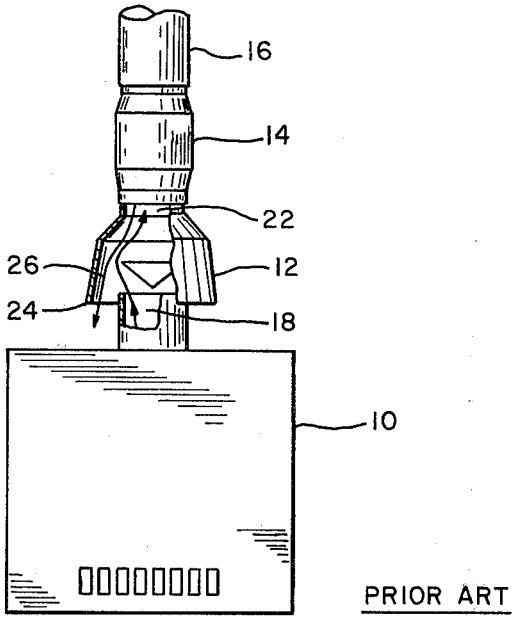
FIG. 1 is a schematic view of a typical prior art combination of heating apparatus, draft hood, vent damper and vent connector.

FIG. 1 shows a typical prior art assembly comprising heating apparatus 10, draft hood 12, vent damper 14 and vent connector 16. During normal operation the vent gases flow upward from the heating apparatus through draft hood inlet 18, hood 12, outlet 22, vent damper 14 and into vent connector 16. If excessive draft prevails considerable amounts of dilution air are drawn into the vent through the annular draft hood relief opening 24. If a backdraft reverses the flow in the vent the gases from the vent, entering through draft hood outlet 22, and the products of combustion coming from the heating apparatus through draft hood inlet 18 flow out of the draft hood at relief opening 24, as shown by arrow 26. In the case of excessive updraft or downdraft the draft hood isolates the combustion process in the heating apparatus from disturbing flows. Draft hoods are therefore required components of natural draft gas-fired heating systems.

Figure 2:
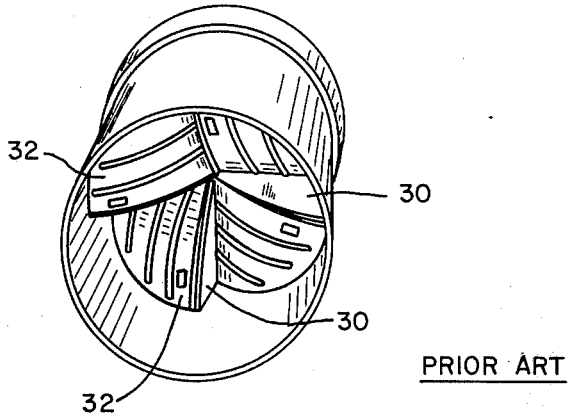
FIG. 2 is a perspective view of a prior art thermally controlled vent damper.

FIG. 2 shows a prior art thermally actuated vent damper. The damper comprises tubular housing 28 which is subdivided by partitions 30 into sections, illustrated as four quadrants. Each quadrant is covered by a thin slotted bimetal blade 32. The blades are attached at their upper edges to the partitions and at room temperature curve upward, touching with their free ends housing 28 and thereby essentially closing the damper. The temperature of hot products of combustion causes the blades to uncurl and to open the passage to the vent.

PREFERRED EMBODIMENTS

Figure 3:
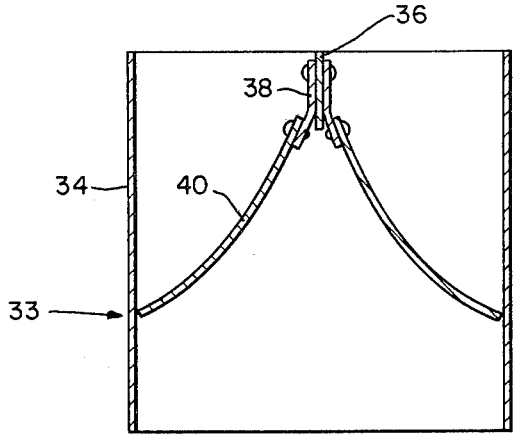
FIG. 3 is an axial section through a vent damper of a first embodiment showing the damper actuating elements in closed position.
Figure 4:
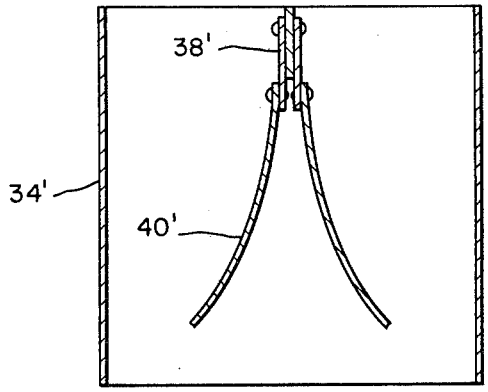
FIG. 4 is a view similar to FIG. 3 showing the actuating element in an intermediate position.
Figure 5:
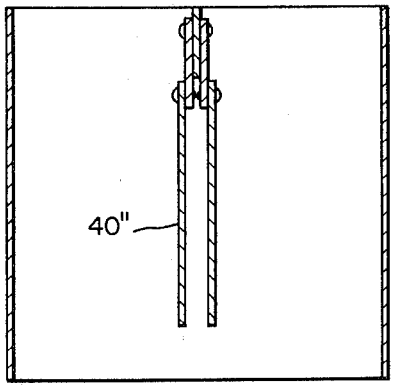
FIG. 5 is a view similar to FIG. 3 showing the actuating element in fully open position.

FIGS. 3, 4 and 5 show the closed position, an intermediate position, and fully opened position, respectively, for a draft control arrangement 33 of the first embodiment of the invention. The draft control arrangement 33 comprises housing 34, partition 36, fastened to the housing and similar in shape to partition 30 in FIG. 2, and two damper actuating elements 38 and 40 which have different temperature response characteristics.

Actuating element 38 is in the shape of a flat blade and is fastened to the partition by rivets, spot welding or other means. The element 38 is formed of a suitable shape memory material, such as nitinol (an alloy of nickel and titanium) which, after heat treatment with concurrent mechanical deformation, is capable of thermoelastic martensitic reversion, also called reversible shape memory, at its phase change temperature. The phase change temperature (e.g., 80° C.) is dependent upon the particular composition of the alloy and the manufacturing process. Actuating element 40 is also in the shape of a flat blade and is fastened to the shape memory element 38 by rivets or other fastening means. The element 40 is of slotted bimetal construction (also known as thermostat metal) having the characteristics of shape change which is approximately proportional to temperature change.

FIG. 3 shows the closed position 38, 40 of the actuating elements. This position is maintained during the standby periods of the heating apparatus. When the heating apparatus starts operating, hot products of combustion from the main burner reach the vent damper. Shape memory blade 38 is heated by the combustion gases to its phase change temperature and thereby changes from shape 38 to shape 38'. Since the shape change of shape memory element 38 occurs substantially instantaneously upon reaching the phase change temperature a relatively large opening between the free end of bimetal blade 40' and housing 34' is rapidly created upon burner ignition.

Figure 7:
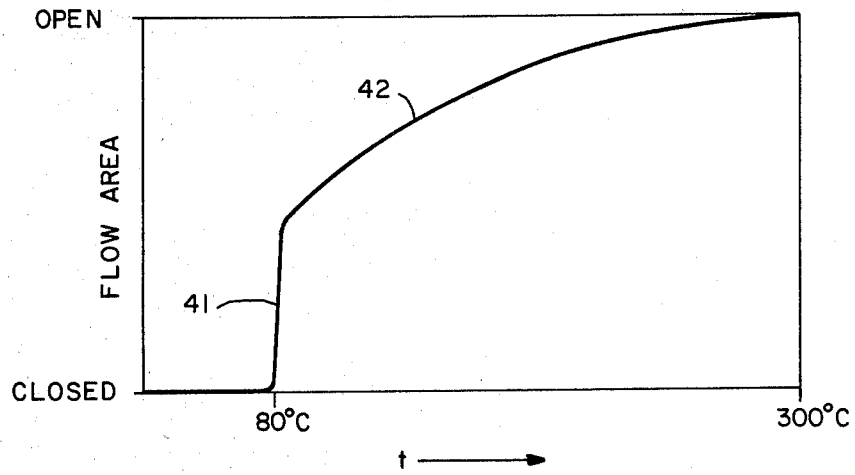
FIG. 7 is a graph illustrating the typical relationship of flow area opening as a function of temperature during operation of apparatus in accordance with the invention.

The graph of FIG. 7 illustrates the change in damper flow area (i.e. the cross-sectional area between the housing and actuating elements) as a function of temperature of the elements. As shown in the graph there is a steep rise in the curve at 41 when the temperature reaches the phase change level of the shape memory element, thereby causing a rapid and large deformation to the memory shape with resulting rapid increase in flow area. The further temperature increase causes bimetal element 40' to uncurl until, at maximum design temperature, e.g. 300° C., it assumes the straight shape 40'' in FIG. 5. The effect on the flow area opening is indicated by the portion marked 42 of the curve in FIG. 7.

An increasing draft in the vent which aspirates additional room air throughout the draft hood relief opening lowers the temperature of the flue gas-air mixture flowing through the vent damper and causes the bimetal blade to modulate between positions 40'' and 40'.

Figure 6:
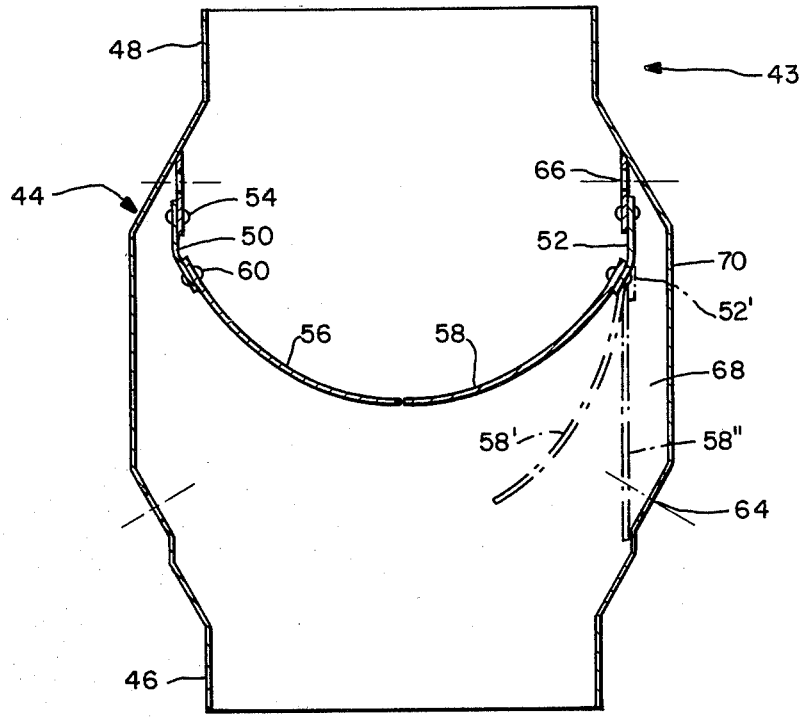
FIG. 6 is an axial section through a vent damper of a second embodiment.

FIG. 6 shows a draft control arrangement 43 providing another preferred embodiment. The arrangement 43 comprises housing 44 having an essentially square cross section with round inlet 46 and round outlet 48, and two symetrically opposed sets of damper actuating elements 50, 56 and 52, 58. In the figure the closed position of the elements are shown in solid lines, the initial opening position of the right element is shown in dashed-dot lines at 58', and the fully open position is shown in dashed-dot lines at 58''. The elements 50 and 52 are formed of a shape memory material such as nitinol and are in the shape of flat blades fastened to opposite sides of the housing by rivets 54. The elements 56 and 58 are of slotted bimetal construction and are fastened by rivets 60 to the distal ends of the shape memory blades 50 and 52. The bimetal blades are designed to touch each other at their free ends across the width of the damper housing and thereby essentially close the passage through the damper at room temperature, as shown by the solid line position in FIG. 6. Upon ignition of the main burner the rising products of combustion heat the temperature-sensitive blades of the damper and as soon as the phase change temperature of the shape memory blades is reached, e.g. 80° C., the shape memory blades straighten substantially instantaneously to shape 52' thereby opening a passage for the products of combustion. A further temperature increase causes the bimetal blades to uncurl and to assume, at maximum design temperature, e.g. 300° C., shape 58''. As in the previous embodiment the bimetal blades are designed to modulate the free passage between the initial opening, determined by the shape change of the shape memory blades, and the fully open position.

In the closed position the bimetal elements 56 and 58 incline across the flow passage and direct the flow of gases to impinge upon the shape memory elements 50 and 52, respectively. This accelerates heating of the shape memory elements to reduce response time following burner ignition.

The embodiment of FIG. 6 offers additional advantages. When the gases flowing through the damper are at the maximum design temperature the closing elements are moved completely out of the flow passage. The resistance to flow is minimized. Also, should the temperature increase beyond the maximum design temperature it will not damage the temperature-sensitive elements since the bimetal blades will touch, with their free ends, the housing and thereby prevent the flow of hot gases across both bimetal surfaces. Only the side facing the center of the damper will continue to be impinged by the hot gases while the side facing the housing will be cooled by air flowing via small ventilation inlets 64 and outlets 66 through a chamber 68 formed between the damper elements and an enlarged portion 70 of the housing.

The shape memory blades may be shorter or longer than shown. They can also be designed to perform a smaller or larger angular movement upon reaching shape change temperature.

In cases where modulation during the operating phase of the heating apparatus is not necessary the closing element of the vent damper may be made entirely of shape memory alloy.

Another option is to manufacture the damper closing means of various shape memory blades with different shape change temperatures.

Most two-way shape memory materials develop more force when deforming from cold to hot than when reverting from hot to cold. This provides additional safety of function. If dirt accumulation or foreign material should cause resistance to the movement of the shape memory blades they would tend to open and remain open rather than fail in the closed position.

When the return force of the shape memory material is very small, or when the application makes it desirable to have approximately the same force available for opening as well as closing of the shape memory components of the vent damper, the shape memory blades may be assisted in their return movements by a spring.

All embodiments of the invention are free from hinges, bearings and friction surfaces. Field experience over many years has shown this feature to be a prerequisite for reliable function of thermally actuated dampers and has been addressed in the pertinent standards, e.g. ANSI Z21.68 and DIN 3388/1 of 1978.

What is claimed is:

1. For use in a heating apparatus having a damper for controlling the flow of exhaust gases through a vent, the combination of means forming a flow passage, flow control means comprising first and second actuating elements formed in the shape of blades disposed in the vent for opening and closing the flow area of the passage in response to temperature change, said first element being formed of a shape memory material which rapidly deforms between two different shapes when heated to its phase change temperature, said second element being formed of a thermostat material which changes shape substantially proportional to temperature change, said first and second elements coacting to provide a rapid rate of flow passage opening during the initial phase of temperature rise following burner ignition followed by a rate of flow area opening substantially proportional to further temperature rise.

2. The invention as in claim 1 in which one end of the first element is attached to one side of the flow passage and the distal end of the first element is attached to an end of the second element.

3. The invention as in claim 2 in which when the flow control means closes the passage the second element inclines across the flow passage and directs the flow of gases to impinge upon the first element following burner ignition.

4. The invention as in claim 2 in which when said first element is at a temperature below said phase change temperature it assumes a shape in which the distal end inclines in a direction generally across the flow passage, and when the first element is at a temperature reaching said phase change temperature it assumes a shape in which the distal end extends generally along the length of the flow passage.

5. The invention as in claim 1 in which the first and second elements when in their position fully opening the flow passage extend along the length of and form a side portion of the flow passage whereby the outside surfaces of the elements are shielded from hot gases flowing within the passage.

6. The invention as in claim 5 in which the flow passage includes means forming a wall radially outwardly from the flow control means and cooperating with the flow control means to form a chamber when the first and second elements extend along the length of the passage to fully open the flow passage, and opening means in the passage for directing ambient gases through the chamber for cooling the outside surfaces of the first and second elements.

7. The invention as in claim 1 in which said flow-control means comprises a plurability of sets of said first and second actuating elements.

8. The invention as in claim 7 in which the distal ends of the elements on opposite sides extend toward a position in which the ends are juxtaposed together for closing the flow passage during a stand-by mode of operation.

* * * * *